US006394070B1

(12) United States Patent
Angelino

(10) Patent No.: US 6,394,070 B1
(45) Date of Patent: May 28, 2002

(54) DUAL VALVE MEMBER AND FUEL INJECTOR USING SAME

(75) Inventor: Joseph Angelino, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/740,477

(22) Filed: Dec. 19, 2000

(51) Int. Cl.[7] ..... F02M 37/04
(52) U.S. Cl. ..... 123/446; 123/300
(58) Field of Search ..... 123/446, 467, 123/299, 300, 456, 458

(56) References Cited

U.S. PATENT DOCUMENTS 5,785,021 A * 7/1998 Yudanov et al. ..... 123/446
5,878,720 A * 3/1999 Anderson et al. ..... 123/496
6,053,421 A * 4/2000 Chockley ..... 239/5
6,129,072 A * 10/2000 Graves ..... 123/446
6,244,250 B1 * 6/2001 Hlousek ..... 123/467

* cited by examiner

*Primary Examiner*—Carl S. Miller
(74) *Attorney, Agent, or Firm*—Liell & McNeil

(57) ABSTRACT

The present invention finds application in fuel injectors having the fluid control passage to the needle valve member coupled to another fluid control passage within the fuel injector. Engineers have learned that decoupling the control passage to the needle valve member with other fluid control passages can allow for greater control of injection events. In addition, by decoupling these fluid passages, it is believed that the fuel injector will perform more like a nominal fuel injector, especially under cold start conditions. Therefore, the present invention utilizes a dual control valve member to independently control fluid flow to the back of the needle valve member and fluid flow to various other components of the fuel injector.

20 Claims, 5 Drawing Sheets

DUAL VALVE MEMBER AND FUEL INJECTOR USING SAME

SUMMARY FIELD

This invention relates generally to dual valve members, and more particularly to controlling fluid flow in a fuel injector using a dual valve member.

BACKGROUND ART

Hydraulically actuated fuel injectors having a single control valve that controls fluid flow to both a spool valve and a direct control needle valve included in the injector body are known in the art. One example of such a fuel injector is disclosed in U.S. Pat. No. 5,738,075 issued to Chen et al. on Apr. 14, 1998. While fuel injectors such as those disclosed in Chen et al. have performed adequately, there remains room for improvement. For instance, because control of fluid pressure to the spool valve control surface is coupled to fluid pressure to the needle valve control surface, undesirable interactions can occur. In addition, the seated pin included in the control valve must have a sufficient size and travel distance to allow the fuel injector to perform as desired when operating under cold start conditions. However, the size and travel distance of the seated pin are limited by the force available from the actuator to overcome the flow and/or viscosity forces present and, in addition, by the required response time. Finally, a substantial amount of fluid must be displaced past the seated pin whenever the spool moves, which runs counter to the desire for short travel distances and times.

The present invention is directed to overcoming one or more of the problems as set forth above.

DISCLOSURE OF THE INVENTION

In one aspect of the present invention, a fuel injector includes an injector body that defines a first passage, a second passage, a variable pressure passage, a pressure communication passage and a nozzle outlet. The variable pressure passage is fluidly isolated from the pressure communication passage. A needle valve member is movably positioned in the injector body and has a closing hydraulic surface exposed to fluid pressure in the pressure communication passage. A dual valve member is positioned in the injector body and has a first valve member and a second valve member. An electrical actuator is operably coupled to the dual valve member. The dual valve member is movable between a first, second and third position.

In another aspect of the present invention, a fuel injection system includes a high pressure source, a low pressure reservoir and a source of fuel. At least one fuel injector is provided that has an injector body that defines a fuel inlet fluidly connected to the source of fuel, a high pressure passage fluidly connected to the high pressure source and a low pressure passage fluidly connected to the low pressure reservoir. The injector body also defines a variable pressure passage, a pressure communication passage and a nozzle outlet. The variable pressure passage is fluidly isolated from the pressure communication passage. A needle valve member is movably positioned in the injector body and has a closing hydraulic surface that is exposed to fluid pressure in the pressure communication passage. A dual valve member is positioned in the injector body and has a first valve member and a second valve member. An electrical actuator is operably coupled to the dual valve member. The dual valve member is movable between a first, second and third position.

In yet another aspect of the present invention, a method of injecting fuel includes a step of providing a fuel injector that has an injector body that defines a high pressure passage, a low pressure passage, a variable pressure passage, a pressure communication passage and a nozzle outlet. The injector includes a dual valve member and a needle valve member. The variable pressure passage is fluidly isolated from the pressure communication passage. A closing hydraulic surface of the needle valve member is exposed to fluid pressure in the pressure communication passage. The dual valve member is biased to a first position in which the variable pressure passage is open to one of the high pressure passage and the low pressure passage, and the pressure communication passage is open to the high pressure passage. The variable pressure passage is then opened to an other of the high pressure passage and the low pressure passage. The nozzle outlet is then opened, at least in part by moving the dual valve member to a third position opening the pressure communication passage to the low pressure passage. Next the nozzle outlet is closed, at least in part by opening the pressure communication passage to the low pressure passage. The variable pressure passage is then opened to the one of the high pressure passage and the low pressure passage.

BEST MODE FOR CARRYING OUT THE INVENTION

Figure 1:
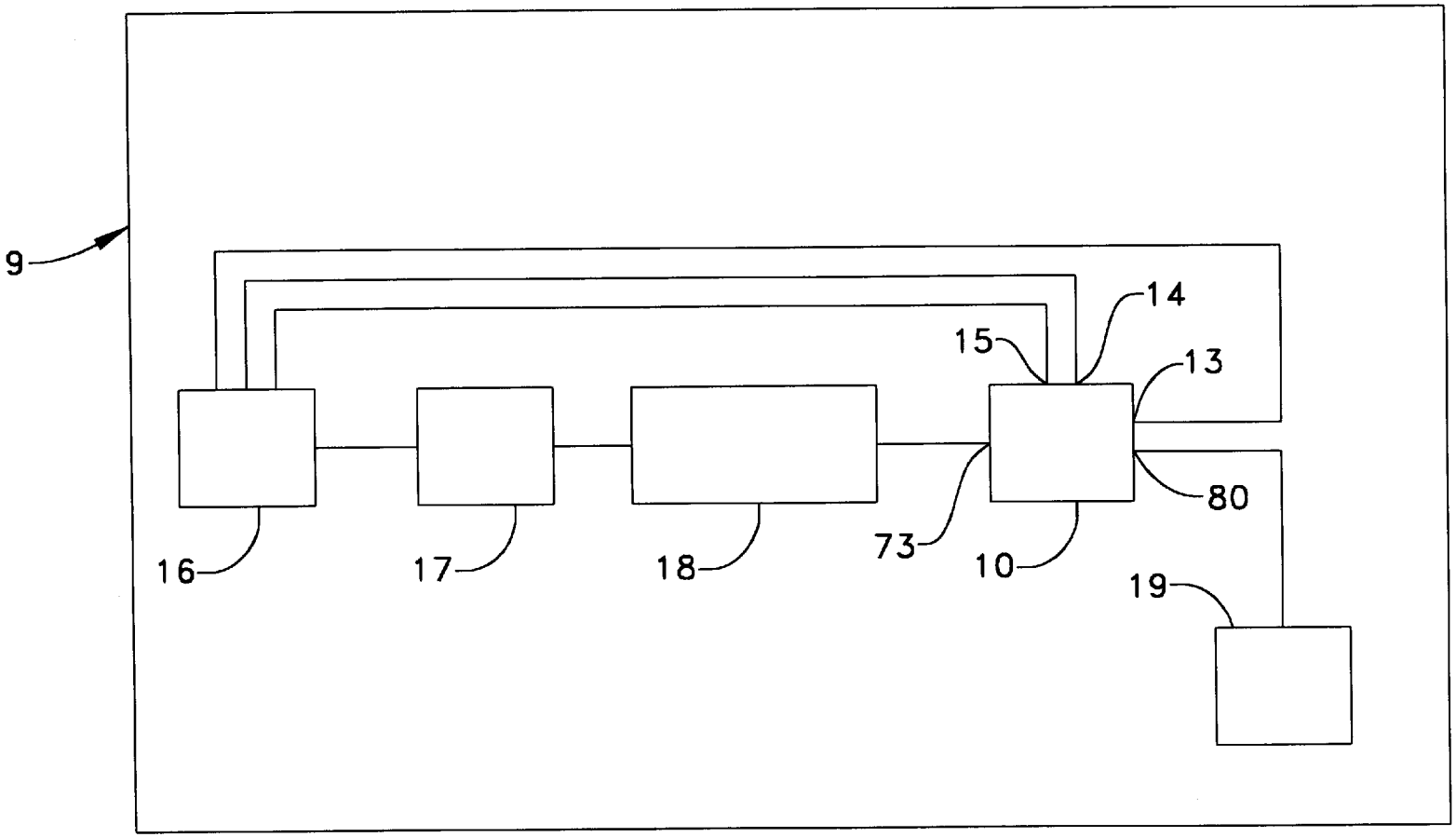
FIG. 1 is a fuel injection system according to the present invention.

Referring now to FIG. 1 there is shown a fuel injection system 9 according to the present invention. Fuel injection system 9 has a low pressure reservoir 16 that contains an amount of hydraulic fluid. Preferably, low pressure reservoir 16 contains an amount of engine lubricating oil, however, it should be appreciated that other fluids, such as fuel, could be utilized as the hydraulic fluid in fuel injection system 9. A high pressure pump 17 pumps oil from low pressure reservoir 16 and delivers it to a high pressure rail 18. High pressure oil from high pressure rail 18 can then enter a high pressure inlet 73 of a fuel injector 10, where it can perform work within the same. During operation of fuel injector 10, oil can flow out of fuel injector 10 via low pressure drains 13, 14, 15 to be returned to low pressure reservoir 16. In addition, a fuel source 19 is provided in fuel injection system 10 and preferably provides medium pressure fuel to fuel injector 10 for each injection event.

Figure 2:
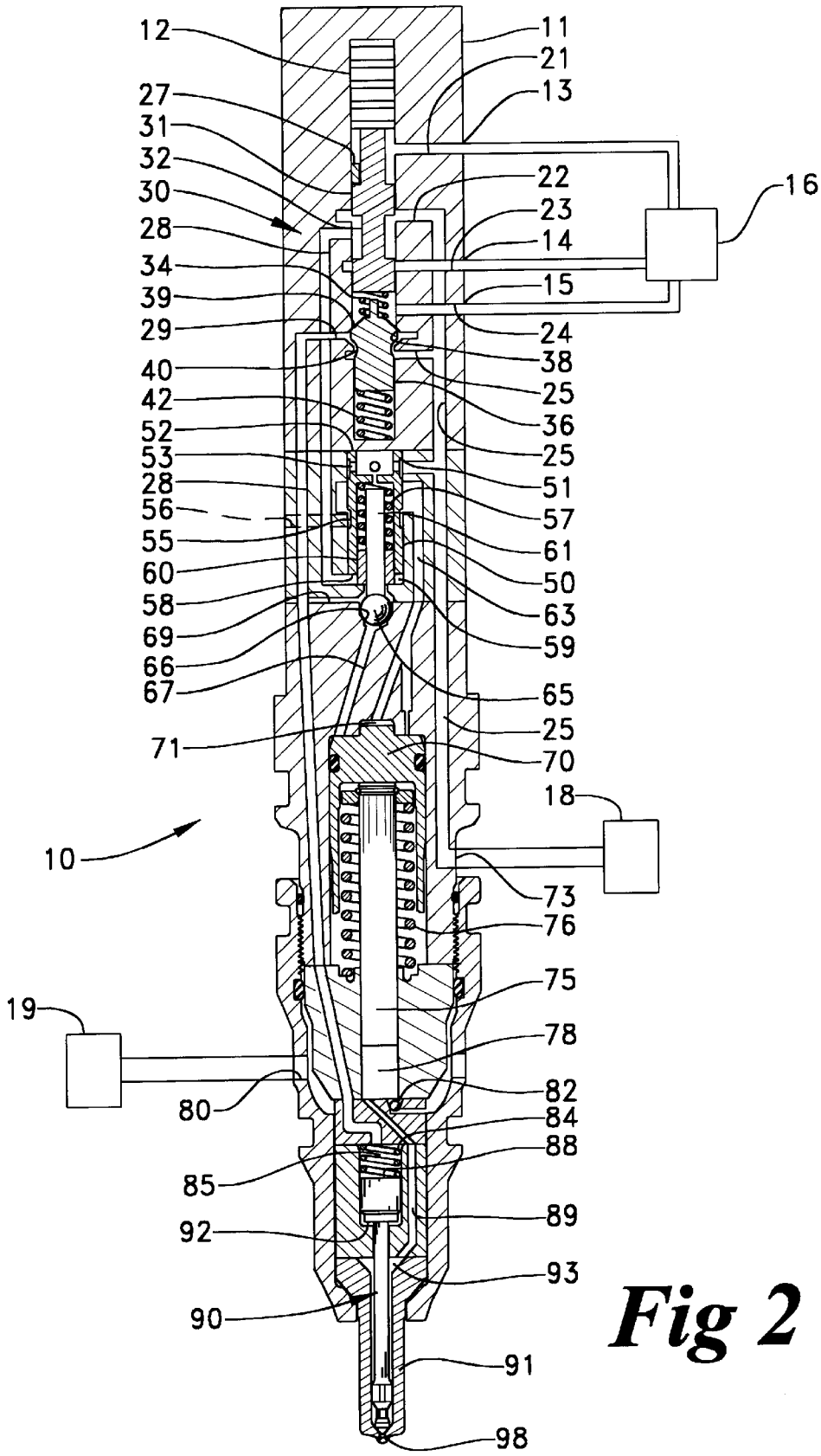
FIG. 2 is a sectioned diagrammatic view of a fuel injector according to the present invention.

Referring now to FIG. 2 there is shown a fuel injector 10 according to the present invention. Fuel injector 10 provides an injector body 11 that contains the various stationary components of fuel injector 10. Injector 10 also includes numerous movable components positioned as they would be between injection events. Attached to fuel injector 10 is an electrical actuator 12. Preferably, electrical actuator 12 is a piezoelectric actuator, however, it should be appreciated that electrical actuator 12 could be any suitable actuator that is capable of displacing a dual valve member 30 movably positioned in injector body 11, and stopping the same in at least one intermediate position between its upward position and its downward position. Thus, actuator 12 could also be a three position solenoid.

Figure 3:
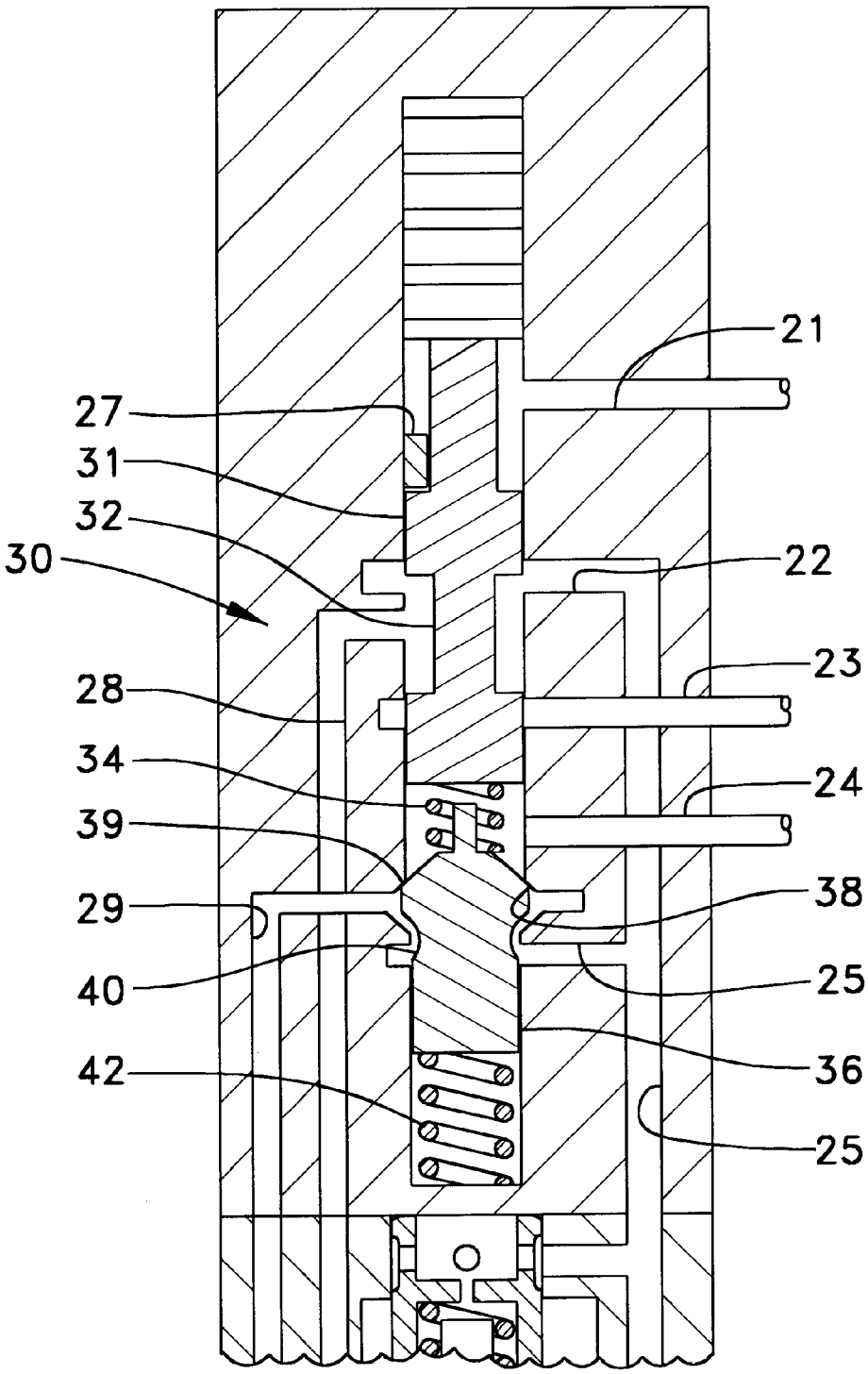
FIG. 3 is a sectioned diagrammatic view of the dual valve member of FIG. 2 in its first position.

Referring in addition to FIG. 3, dual valve member 30 is operably coupled to electrical actuator 12. Dual valve member 30 has a first valve member 31 that is biased toward an upward position by a biasing spring 34 and a second valve member 36 that is biased toward an upward position by a biasing spring 42. Preferably, biasing spring 42 provides a stronger biasing force than biasing spring 34, such that a greater force must be applied to dual valve member 30 to move second valve member 36 to its downward position than is needed to move first valve member 31 to its downward position. Dual valve member 30 is limited in its upward movement by a stop component 27 that is preferably defined by injector body 11. In addition, injector body 11 defines a low pressure passage 21 to allow any fluid that migrates upward past first valve member 31 to be displaced from fuel injector 10.

Injector body 11 defines a variable pressure passage 28 that can be fluidly connected to either a high pressure passage 22 or a low pressure passage 23 by an annulus 32 provided on first valve member 31. Similarly, injector body 11 defines a pressure communication passage 29 that can be fluidly connected to either a low pressure passage 24 or a high pressure passage 25 by an annulus 40 provided on second valve member 36. As illustrated in FIG. 3, when electrical actuator 12 is de-energized, dual valve member 30 is in its first, upward position and both first valve member 31 and second valve member 36 are in their upward positions. When dual valve member 30 is in this position, variable pressure passage 28 is fluidly connected to high pressure passage 22 and pressure communication passage 29 is fluidly connected to high pressure passage 25.

Figure 4:
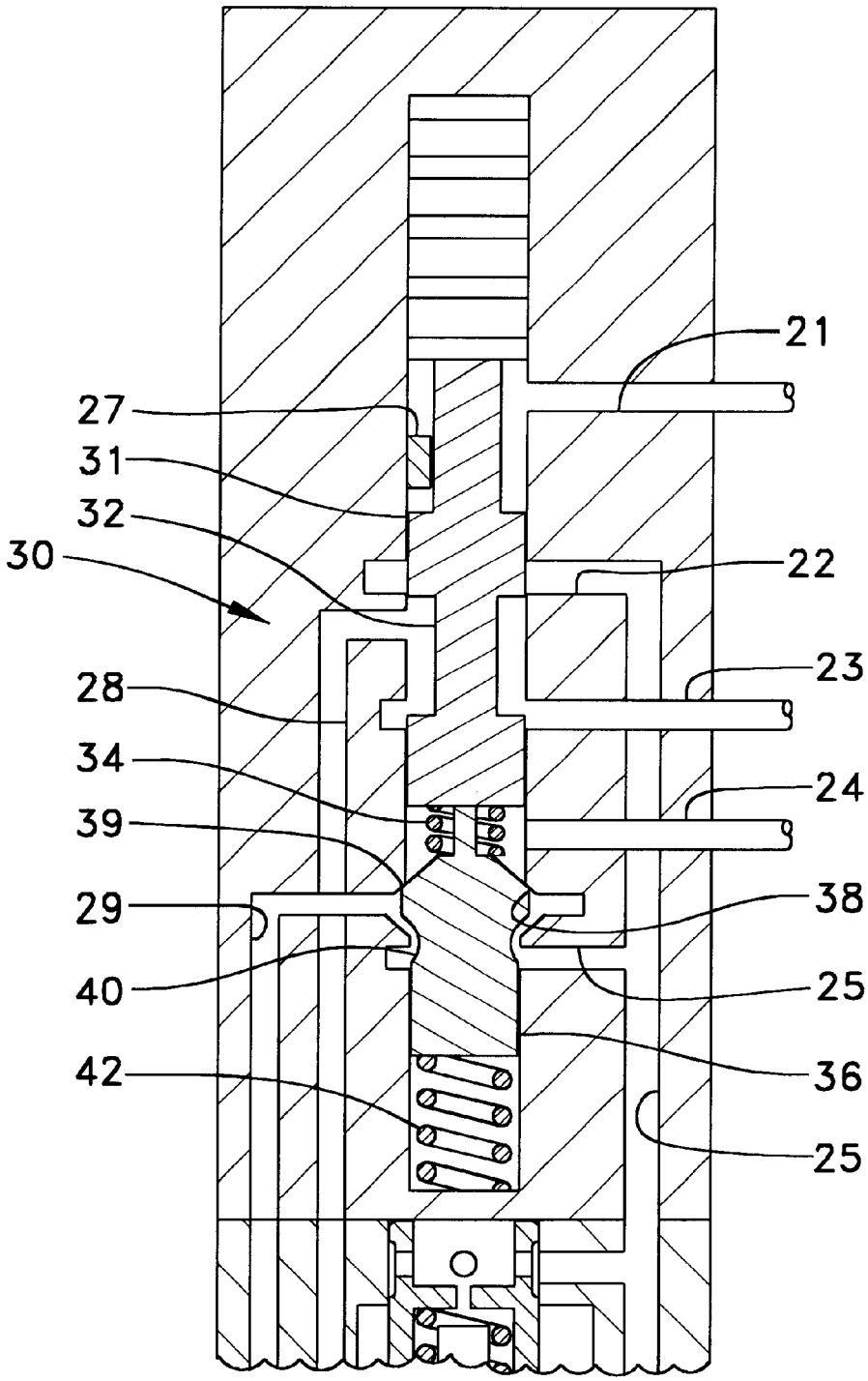
FIG. 4 is a sectioned diagrammatic view of the dual valve member of FIG. 2 in its second position.

When electrical actuator 12 is energized to its lower voltage level, the piezo device expands to displace dual valve member 30 to a second position, as illustrated in FIG. 4. When dual valve member 30 is in this position, first valve member 31 is moved to its downward position against the force of biasing spring 34 into contact with second valve member 36. Variable pressure passage 28 is now fluidly connected to low pressure passage 23 and blocked from high pressure passage 22. However, because the downward displacement force exerted by electrical actuator 12 is not sufficient to overcome the force of biasing spring 42, second valve member 36 remains it its upward position, fluidly connecting pressure communication passage 29 to high pressure passage 25.

Figure 5:
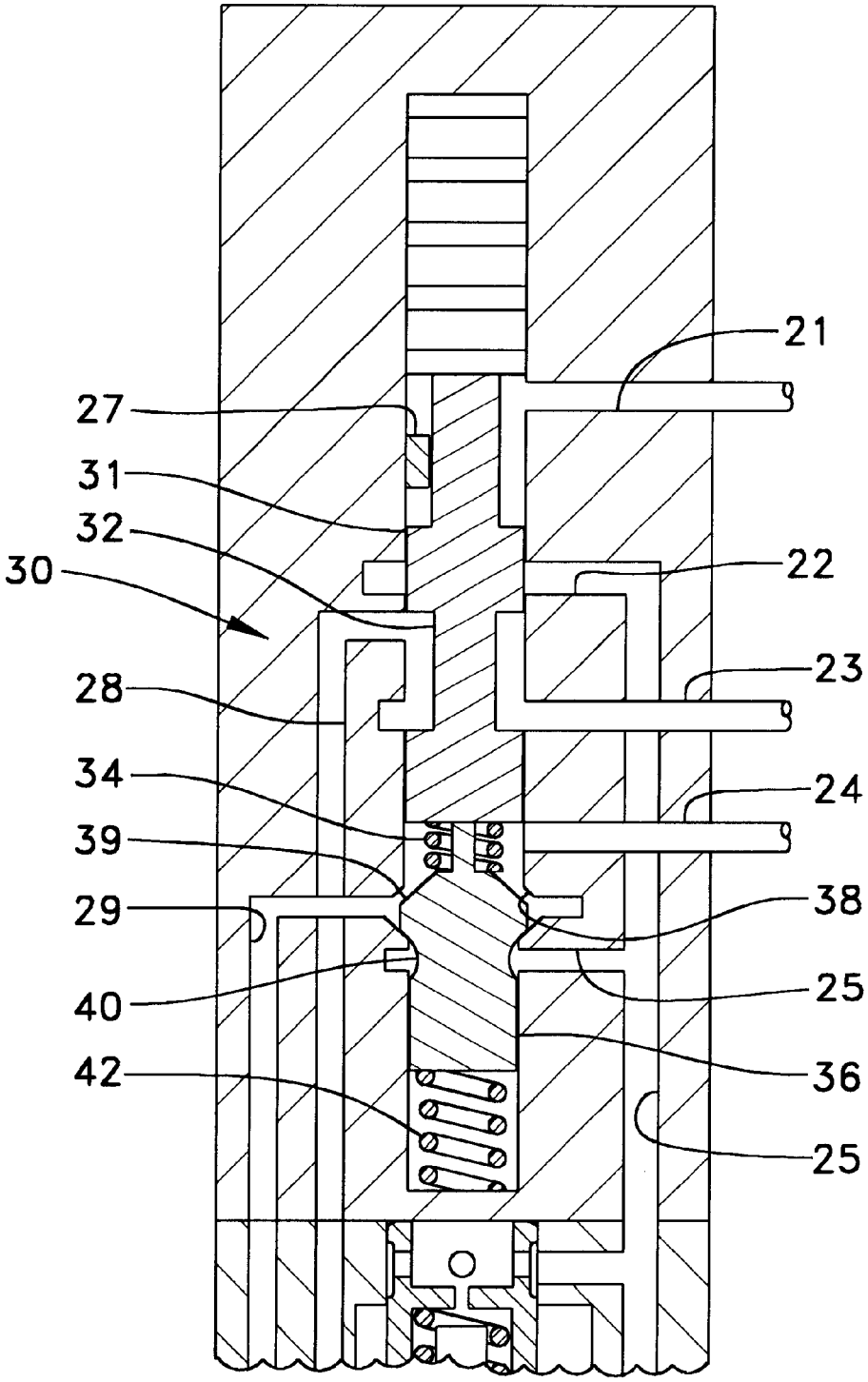
FIG. 5 is a sectioned diagrammatic view of the dual valve member of FIG. 2 in its third position.

When electrical actuator 12 is energized to its higher voltage level, it can further expand to move dual valve member 30 to its third position, as illustrated in FIG. 5. When dual valve member 30 is in this position, first valve member 31 will move farther downward while maintaining a fluid connection between variable pressure passage 28 and low pressure passage 23. However, because the displacement force exerted by electrical actuator 12 is now sufficient to overcome the force of biasing spring 42, second valve member 36 is now moved to its downward position. When second valve member 36 is in this position, a valve surface 39 provided on second valve member 36 is out of contact with a valve seat 38 that is defined by injector body 11. In this position, pressure communication passage 29 is fluidly connected to low pressure passage 24 and blocked from high pressure passage 25.

Returning to FIG. 2, a spool valve member 50 is positioned in injector body 11 and is movable between an upward, retracted position and a downward, advanced position. Spool valve member 50 is biased toward its upward position, as shown, by a biasing spring 57. Spool valve member 50 has a high pressure annulus 51 that is always open to high pressure passage 25 and is positioned such that it can open an actuation fluid passage 63 to high pressure passage 25 when spool valve member 50 is in its advanced position. A low pressure annulus 55 is also provided on spool valve member 50 that can connect actuation fluid passage 63 to a low pressure passage 56 defined by injector body 11 when spool valve member 50 is in its retracted position. Spool valve member 50 has a hydraulic surface 58 that is exposed to fluid pressure in a spool cavity 59, and a high pressure surface 52 that is continuously exposed to high pressure in high pressure passage 25 via a number of radial passages 53 defined by spool valve member 50. Spool cavity 59 is fluidly connected to variable pressure passage 28 thus exposing hydraulic surface 58 to fluid pressure in the same.

When variable pressure passage 28 is fluidly connected to high pressure passage 22, such as when dual valve member 30 is in its first position, pressure within spool cavity 59 is high and spool valve member 50 is preferably hydraulically balanced and maintained in its upward position by biasing spring 57. When spool valve member 50 is in this position, actuation fluid passage 63 is blocked from fluid communication with high pressure passage 25 but fluidly connected to low pressure passage 56 via low pressure annulus 55. Conversely, when variable pressure passage 28 is fluidly connected to low pressure passage 23 by first valve member 31, such as when dual valve member 30 is in its second or third position, pressure within spool cavity 59 is sufficiently low that the high pressure acting on high pressure surface 52 can overcome the force of biasing spring 57, and spool valve member 50 can move to its lower position. When spool valve member 50 is in this lower position, actuation fluid passage 63 is blocked from low pressure passage 56 but high pressure fluid can flow into actuation fluid passage 63 via high pressure annulus 51 and high pressure passage 25.

Returning now to the hydraulic pressurizing means of fuel injector 10, an intensifier piston 70 is movably positioned in injector body 11 and has a hydraulic surface 71 that is exposed to fluid pressure in actuation fluid passage 63. Piston 70 is biased toward a retracted, upward position by a biasing spring 76. However, when pressure within actuation fluid passage 63 is sufficiently high, such as when it is open to high pressure passage 25, piston 70 can move to an advanced, downward position against the action of biasing spring 76. A plunger 75 is also movably positioned in injector body 11 and moves in a corresponding manner with piston 70. When piston 70 is moved toward its advanced position, plunger 75 also advances and acts to pressurize fuel within a fuel pressurization chamber 78 that is connected to a fuel inlet 80 past a check valve 82. Fuel inlet 80 is in fluid communication with fuel source 19 via a fuel supply line. During an injection event as plunger 75 moves toward its downward position, check valve 82 is closed and plunger 75 can act to compress fuel within fuel pressurization chamber 78. When plunger 75 is returning to its upward position, fuel is drawn into fuel pressurization chamber 78 past check valve 82. Fuel pressurization chamber 78 is fluidly connected to a nozzle outlet 98 via a nozzle supply passage 89.

A pressure relief valve 65 is movably positioned in injector body 11 to vent pressure spikes from actuation fluid passage 63. Pressure spikes can be created when piston 70 and plunger 75 abruptly stop their downward movement due to the abrupt closure of nozzle outlet 98. Because pressure spikes can sometimes cause an uncontrolled and undesirable secondary injection due to an interaction of components and passageways over a brief instant after main injection has ended, a pressure relief passage 67 extends between actuation fluid passage 63 and a low pressure vent passage 69. When spool valve member 50 is in its downward position, such as during an injection event, a pin 61 holds pressure relief valve 65 downward to close a seat 66. When pressure relief valve 65 is in this position, pressure relief passage 67 is closed to low pressure vent passage 69 and pressure can build within actuation fluid passage 63. However, between injection events, when piston 70 and plunger 75 are hydraulically locked, residual high pressure in actuation fluid passage 63 can act against pressure relief valve 65. Because pressure within spool cavity 59 is high, spool valve member 50 is hydraulically balanced and can move toward its upward position under the action of biasing spring 57. Pressure relief valve 65 can then lift off of seat 66 to open pressure relief passage 67 to low pressure vent passage 69, thus allowing pressure within actuation fluid passage 63 to be reduced. At the same time, upward movement of pressure relief valve 65, and therefore pin 61 can aid in the movement of spool valve member 50 toward its upward position.

Returning to fuel injector 10, a direct control needle valve 90 is positioned in injector body 11 and has a needle valve member 91 that is movable between a first position, in which a nozzle outlet 98 is open, and a downward second position in which nozzle outlet 98 is blocked. Needle valve member 91 is mechanically biased toward its downward closed position by a biasing spring 85. Needle valve member 91 has an opening hydraulic surface 92 that is exposed to fluid pressure within a nozzle chamber 93 and a closing hydraulic surface 88 that is exposed to fluid pressure within a needle control chamber 84. Pressure communication passage 29 is in fluid communication with needle control chamber 84 and controls fluid pressure within the same. Therefore, when pressure communication passage 29 is fluidly connected to high pressure passage 25 by second valve member 36, such as when dual valve member 30 is in its first or second position, closing hydraulic surface 88 is exposed to high pressure fluid in needle control chamber 84. When pressure communication passage 29 is fluidly connected to low pressure passage 24 by second valve member 36, such as when dual valve member 30 is in its third position, closing hydraulic surface 88 is exposed to low pressure fluid in needle control chamber 84.

Closing hydraulic surface 88 and opening hydraulic surface 92 are preferably sized such that even when a valve opening pressure is attained in nozzle chamber 93, needle valve member 91 will not lift open when needle control chamber 84 is fluidly connected to high pressure passage 25 via dual valve member 30 and pressure communication passage 29. However, it should be appreciated that the relative sizes of closing hydraulic surface 88 and opening hydraulic surface 92 and the strength of biasing spring 85 should be such that when closing hydraulic surface 88 is exposed to low pressure in needle control chamber 84, the high pressure acting on opening hydraulic surface 92 should be sufficient to move needle valve member 91 upward against the force of biasing spring 85 to open nozzle outlet 98.

INDUSTRIAL APPLICABILITY

Prior to the start of an injection event, low pressure in fuel pressurization chamber 78 prevails and plunger 75 is in its retracted position, dual valve member 30 is in its first position such that first valve member 31 is in its upward position fluidly connecting variable pressure passage 28 to high pressure passage 22 and second valve member 36 is in its upward position fluidly connecting pressure communication passage 29 with high pressure passage 25. Closing hydraulic surface 88 is exposed to high pressure in needle control chamber 84 such that needle valve member 91 is in its biased position closing nozzle outlet 98. Spool cavity 59 is in fluid communication with high pressure passage 22 via variable pressure passage 28 and spool valve member 50 is hydraulically balanced and biased toward its upward position by biasing spring 57. Actuation fluid passage 63 is in fluid communication with low pressure passage 56 via low pressure annulus 55. The injection event is initiated by activation of electrical actuator 12 to its lower voltage level, which expands to its first orientation to move dual valve member 30 to its second position.

When dual valve member 30 moves to its second position, first valve member 31 is moved to its downward position fluidly connecting variable pressure passage 28 to low pressure passage 23 and blocking the same from high pressure passage 22. Spool hydraulic surface 58 is now exposed to low pressure in spool cavity 59 and the high pressure acting on high pressure surface 52 is sufficient to move spool valve member 50 to its advanced position. Actuation fluid passage 63 is now fluidly connected to high pressure passage 25 via high pressure annulus 51. High pressure actuation fluid now acts on hydraulic surface 71, causing piston 70 and plunger 75 to start moving toward their advanced positions to pressurize fuel in fuel pressurization chamber 78 and nozzle chamber 93. However, because closing hydraulic surface 88 is exposed to high pressure in needle control chamber 84, needle valve member 91 will not be moved to its upward position to open nozzle outlet 98. Further, it should be appreciated that piston 70 and plunger 75 move only a slight distance at this time because of hydraulic locking, which is a result of nozzle outlet 98 remaining closed. However, the slight movement of piston 70 and plunger 75 is still sufficient to raise fuel pressure within fuel pressurization chamber 78 to injection pressure levels.

Just prior to the desired start of injection, electrical actuator 12 is energized to its higher voltage level and expands to its second orientation. Dual valve member 30 is now displaced to its third position. The displacement force created by the expansion of electrical actuator 12 is now sufficient to overcome the force of biasing spring 42, and second valve member 36 is moved to its downward position. Pressure communication passage 29 is now blocked from fluid communication with high pressure passage 25 and is fluidly connected to low pressure passage 24. Because high pressure is no longer acting on closing hydraulic surface 88, the fuel pressure in nozzle chamber 93 is sufficient to overcome the bias of biasing spring 85 and needle valve member 91 moves to its open position to allow fuel spray into the combustion chamber to commence. Further, because nozzle outlet 98 is now open, piston 70 and plunger 75 can move toward their fully advanced positions.

If a split injection is desired, voltage to electrical actuator 12 is reduced, and electrical actuator 12 contracts to its first orientation, reducing the displacement force exerted on dual valve member 30 and returning the same to its second position. When dual valve member 30 returns to its second position, first valve member 31 remains in its downward position, but the displacement force exerted by electrical actuator 12 is no longer sufficient to maintain second valve member 36 in its downward position, and therefore it returns to its upward position. Pressure communication passage 29 is then reconnected to high pressure passage 25, exposing closing hydraulic surface 88 to high pressure in needle control chamber 84. The upward force exerted on opening hydraulic surface 92 is no longer sufficient to hold needle valve member 91 in its open position, and it moves to its closed position to block nozzle outlet 98.

Shortly before it is desired to reopen nozzle outlet 98, voltage to electrical actuator 12 is then quickly increased, causing the same to expand to its second orientation. Dual valve member 30 is returned to its third position, and pressure communication passage 29 is once again fluidly connected to low pressure passage 24. Closing hydraulic surface 88 is now exposed to low pressure in needle control chamber 84, and the pressure exerted on opening hydraulic surface 92 in nozzle chamber 93 is sufficient to move needle valve member 91 to its open position. Fuel spray into the combustion chamber can once again occur. Any desirable duration between the two shots of a split injection can be obtained without affecting the spool position.

Just prior to the desired end of the injection event, voltage to electrical actuator 12 is ended and it can contract to its original position. With no downward displacement force now being exerted on dual valve member 30, it can return to its first position. First valve member 31 and second valve member 36 then return to their upward positions under the force of biasing springs 34 and 42, respectively. Because biasing spring 42 has a stronger biasing force than biasing spring 34, second valve member 36 will return to its upward position shortly before first valve member 31, and can aid in the upward movement of the same. Pressure communication passage 29 is reconnected to high pressure passage 25, exposing closing hydraulic surface 88 to high pressure in needle control chamber 84. The high pressure acting on closing hydraulic surface 88 is sufficient to move needle valve member 91 downward to close nozzle outlet 98 and end injection. Because of hydraulic locking, piston 70 and plunger 75 stop their advancing movement, but do not immediately begin to retract because of residual high pressure acting on hydraulic surface 71.

When first valve member 31 returns to its upward position, variable pressure passage 28 is now reconnected to high pressure passage 22, thus exposing hydraulic surface 58 to high pressure in spool cavity 59. Spool valve member 50 once again becomes hydraulically balanced and begins to move toward its upward position under the action of biasing spring 57. Residual high pressure in actuation fluid passage 63 is sufficient to move pressure relief valve 65 upward away from seat 66 to fluidly connect pressure relief passage 67 to low pressure vent passage 69. Pressure relief valve 65 can therefore help vent high pressure actuation fluid from actuation fluid passage 63 to prevent pressure spikes from causing undesired secondary injections. At the same time, the upward movement of pressure relief valve 65 causes pin 61 to aid spool valve member 50 in returning to its upward position.

Once pressure relief passage 67 is opened to low pressure vent passage 69, pressure within actuation fluid passage 63 is reduced and piston 70 and plunger 75 can return to their upward positions. In addition, once spool valve member 50 is returned to its upward position, actuation fluid passage 63 is blocked from fluid communication with high pressure passage 25 and fluidly connected to low pressure passage 56, which further reduces the pressure within actuation fluid passage 63. As plunger 75 retracts, fuel from fuel source 19 can be drawn into fuel pressurization chamber 78 via fuel inlet 80 past check valve 82. Used actuation fluid is displaced into the drain.

The dual valve member of the present invention can improve previous fuel injectors in a number of ways. First, control of the spool valve has been decoupled from control of the needle valve, the spool valve can move prior to the opening of the needle valve, and remain in its advanced position when split injections are occurring. Additionally, because movement of the needle valve and the spool valve have been decoupled, pressure applied to the back of the needle can be relieved without risking movement of the spool valve; thus allowing the injector to have a more linear behavior of the needle valve pressure versus time. Further, because the seated pin of previous injectors has been replaced, injector capability is no longer limited by the amount of fluid that must flow past the seated pin, or the amount of force that must be applied to move the pin.

It should be understood that the above description is intended for illustrative purposes only, and is not intended to limit the scope of the present invention in any way. For instance, while the present invention has been illustrated including a spool valve member to control fluid flow to the top of the intensifier piston, it should be appreciated that the dual valve member of the present invention could also be used to replace both the seated pin and the spool valve member in hydraulically actuated fuel injectors. Thus, those skilled in the art will appreciate that other aspects, objects and advantages of this invention can be obtained from a study of the drawings, the disclosure and the appended claims.

What is claimed is:

1. A fuel injector comprising:

an injector body defining a first passage, a second passage, a variable pressure passage, a pressure communication passage and a nozzle outlet;

said variable pressure passage being fluidly isolated from said pressure communication passage;

a needle valve member being movably positioned in said injector body and including a closing hydraulic surface exposed to fluid pressure in said pressure communication passage;

a dual valve member being positioned in said injector body and including a first valve member and a second valve member;

an electrical actuator being operably coupled to said dual valve member;

said dual valve member being movable to a first position in which said variable pressure passage is fluidly connected to one of said first passage and said second passage, and said pressure communication passage is fluidly connected to said first passage;

said dual valve member being movable to a second position in which said variable pressure passage is open to an other of said first passage and said second passage, and said pressure communication passage is open to said first passage; and said dual valve member being movable to a third position in which said variable pressure passage is open to said other of said first passage and said second passage, and said pressure communication passage is open to said second passage.

2. The fuel injector of claim 1 wherein said variable pressure passage is open to said first passage when said dual valve member is in said first position;

said variable pressure passage is open to said second passage when said dual valve member is in said second position; and said variable pressure passage is open to said second passage when said dual valve member is in said third position.

3. The fuel injector of claim 1 wherein a spool valve member is movably positioned in said injector body; and said spool valve member includes a hydraulic surface exposed to fluid pressure in said variable pressure passage.

4. The fuel injector of claim 1 wherein said electrical actuator is a piezoelectric actuator.

5. The fuel injector of claim 1 wherein said first passage is fluidly connected to a source of high pressure fluid and said second passage is fluidly connected to a low pressure reservoir.

6. The fuel injector of claim 1 wherein said needle valve member is movable between a first position in which said nozzle outlet is open and a second position in which said nozzle outlet is blocked.

7. The fuel injector of claim 1 including an intensifier piston movably positioned in said injector body and including a piston hydraulic surface; and said piston hydraulic surface being exposed to high pressure actuation fluid when said dual valve member is in said second position and said third position.

8. The fuel injector of claim 1 wherein said first valve member is movable between a first position in which said variable pressure passage is open to said one of said first passage and said second passage and a second position in which said variable pressure passage is open to said other of said first passage and said second passage; and said second valve member is movable between a first position in which said pressure communication passage is fluidly connected to said first passage and a second position in which said pressure communication passage is fluidly connected to said second passage.

9. A fuel injection system comprising:

a high pressure source, a low pressure reservoir and a source of fuel;

at least one fuel injector including an injector body that defines a fuel inlet fluidly connected to said source of fuel, a high pressure passage fluidly connected to said high pressure source, a low pressure passage fluidly connected to said low pressure reservoir, a variable pressure passage, a pressure communication passage and a nozzle outlet;

said variable pressure passage being fluidly isolated from said pressure communication passage;

a needle valve member being movably positioned in said injector body and including a closing hydraulic surface exposed to fluid pressure in said pressure communication passage;

a dual valve member being positioned in said injector body and including a first valve member and a second valve member;

an electrical actuator being operably coupled to said dual valve member;

said dual valve member being movable to a first position in which said variable pressure passage is fluidly connected to one of said high pressure passage and said low pressure passage, and said pressure communication passage is fluidly connected to said high pressure passage;

said dual valve member being movable to a second position in which said variable pressure passage is open to an other of said high pressure passage and said low pressure passage, and said pressure communication passage is open to said high pressure passage; and said dual valve member being movable to a third position in which said variable pressure passage is open to said other of said high pressure passage and said low pressure passage, and said pressure communication passage is open to said low pressure passage.

10. The fuel injection system of claim 9 wherein said needle valve member is movable between a first position in which said nozzle outlet is open and a second position in which said nozzle outlet is blocked.

11. The fuel injection system of claim 10 wherein said electrical actuator is a piezoelectric actuator.

12. The fuel injection system of claim 11 including a spool valve member movably positioned in said injector body and including a hydraulic surface exposed to fluid pressure in said variable pressure passage.

13. The fuel injection system of claim 12 wherein said variable pressure passage is open to said high pressure passage when said dual valve member is in said first position;

said variable pressure passage is open to said low pressure passage when said dual valve member is in said second position; and said variable pressure passage is open to said low pressure passage when said dual valve member is in said third position.

14. The fuel injection system of claim 13 wherein said first valve member is movable between a first position in which said variable pressure passage is open to said one of said first passage and said second passage and a second position in which said variable pressure passage is open to said other of said first passage and said second passage; and said second valve member is movable between a first position in which said pressure communication passage is fluidly connected to said first passage and a second position in which said pressure communication passage is fluidly connected to said second passage.

15. A method of injecting fuel comprising:

providing a fuel injector including an injector body defining a high pressure passage, a low pressure passage, a variable pressure passage, a pressure communication passage and a nozzle outlet, and including a dual valve member and a needle valve member;

fluidly isolating said variable pressure passage from said pressure communication passage;

exposing a closing hydraulic surface of said needle valve member to fluid pressure in said pressure communication passage;

biasing said dual valve member to a first position in which said variable pressure passage is open to one of said high pressure passage and said low pressure passage and said pressure communication passage is open to said high pressure passage;

opening said variable pressure passage to an other of said high pressure passage and said low pressure passage, at least in part by moving said dual valve member to a second position;

opening said nozzle outlet, at least in part by moving said dual valve member to a third position opening said pressure communication passage to said low pressure passage;

closing said nozzle outlet, at least in part by opening said pressure communication passage to said high pressure passage; and opening said variable pressure passage to said one of said high pressure passage and said low pressure passage.

16. The method of claim 15 wherein said step of opening said nozzle outlet occurs at least twice before said step of opening said variable pressure passage to said one of said high pressure passage and said low pressure passage.

17. The method of claim 15 wherein a spool valve member is movably positioned in said fuel injector; and exposing a hydraulic surface of said spool valve member to fluid pressure in said variable pressure passage.

18. The method of claim 15 wherein moving said dual valve member to said second position and said third position includes displacing said dual valve member with an electrical actuator.

19. The method of claim 15 including exposing said closing hydraulic surface of said needle valve member to said high pressure passage when said dual valve member is in said second position.

20. The method of claim 15 wherein said step of opening said nozzle outlet includes a step of exposing an opening hydraulic surface of said needle valve member to high pressure fuel in a nozzle chamber defined by said injector body.

* * * * *